United States Patent [19]

Owens

[11] Patent Number: 4,934,725

[45] Date of Patent: Jun. 19, 1990

[54] PORTABLE STANDING ATTACHMENT FOR WHEELCHAIRS

[76] Inventor: Jesse Owens, 679 Second St., Palmer, Ak. 99645

[21] Appl. No.: 319,337

[22] Filed: Mar. 6, 1989

[51] Int. Cl.[5] ..... A47C 1/00

[52] U.S. Cl. ..... 280/304.1; 297/DIG. 4

[58] Field of Search ..... 280/304.1, 242.1, 648, 280/647, 650, 250.1; 297/DIG. 4, DIG. 10

[56] References Cited

U.S. PATENT DOCUMENTS

| | | | |
|---|---|---|---|
| 2,596,055 | 5/1952 | Thomas | 155/22 |
| 2,759,525 | 8/1956 | Ries | 155/22 |
| 2,855,979 | 10/1958 | Hubbard | 155/22 |
| 3,023,048 | 2/1962 | Barton | 297/330 |
| 3,398,974 | 8/1968 | Edwards et al. | 280/304.1 |
| 3,405,954 | 10/1968 | Wolfe | 280/304.1 |
| 3,584,890 | 6/1971 | Presty | 280/7.1 |
| 3,912,032 | 10/1975 | Benz et al. | 180/13 |
| 4,076,304 | 2/1978 | Deucher | 297/45 |
| 4,120,530 | 10/1978 | Imbro | 297/337 |
| 4,360,213 | 11/1982 | Rudwick et al. | 280/242 WC |
| 4,506,930 | 3/1985 | Lambert | 297/423 |
| 4,617,919 | 10/1986 | Suhre | 128/78 |
| 4,676,416 | 6/1978 | Harmon | 224/42.46 R |
| 4,685,693 | 8/1987 | Vadjunec | 280/242 WC |

*Primary Examiner*—Charles A. Marmor
*Assistant Examiner*—Alan M. Kagen
*Attorney, Agent, or Firm*—James C. Wray

[57] ABSTRACT

A portable standing attachment for wheelchairs has first and second identical side assemblies constructed of front members, side members and stabilizers. The front member has a lower end pivoted on a pin extending laterally from a lower forward frame member of the wheelchair. A forward end of the side member is hinged near an upper end of a front member, and a rearward end of the side member is connected to the backrest frame of the wheelchair. An upper end of the stabilizer is pivotally connected to the front member. The stabilizer extends forward and downward through a guide on the side of a footrest. An upper cross bar has one end pivoted to an upper end of a front member. The other end of the cross bar telescopically connects to the upper end of the other frame member. Convertible armrests/-knee supports are connected to the front members. Sliding upward on an armrest releases its upper end to pivot across the frame and to attach to the opposite front member after first twisting the cushion 180° around its universal joint to form a knee support. The armrests are oppositely connected to form two parallel close together knee supports. A buttocks support is connected to one side member and swings across the back of the body as a person stands and engages to the other side member to support the person in a standing position. Two downward and rearward opening hooks on the side member engage short tubular receivers connected behind the main wheel axles to hold the side member in sitting position with the front members diagonally positioned on sides of the wheelchair. The upper cross bar is connected at the top of the side members behind the backrest. The stabilizers remain in the guides so that they automatically are positioned and retracted as the side assemblies are moved to the standing and sitting positions. A leg strap extends across lower front frame members of the wheelchair and lateral inward facing cushions are connected to the front lower frame members to cooperate with the knee supports and buttocks support in rigidly supporting a person's legs in the standing attachment.

20 Claims, 6 Drawing Sheets

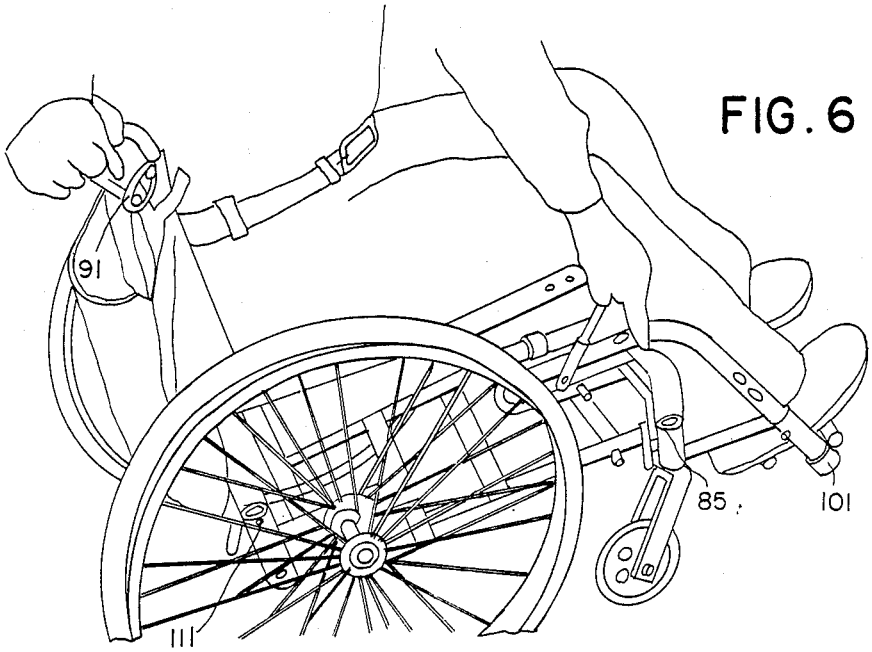
FIG. 6
FIG. 5
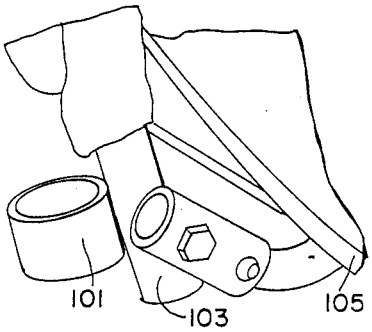
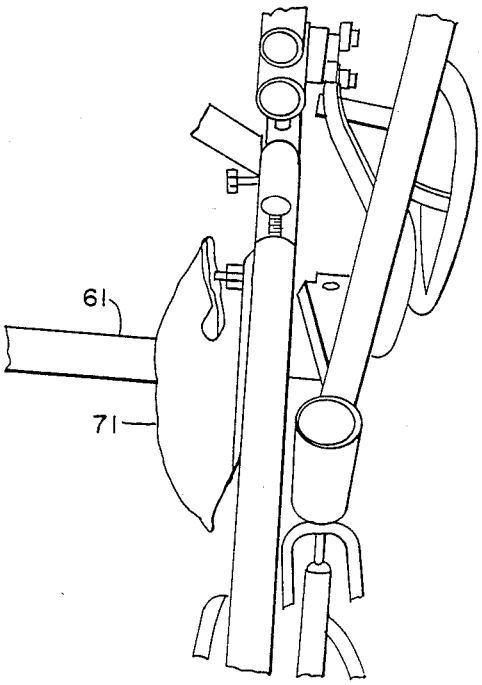
FIG. 7
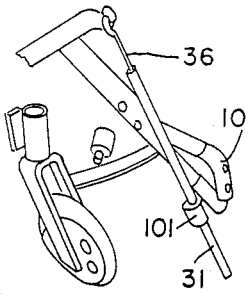
FIG. 8

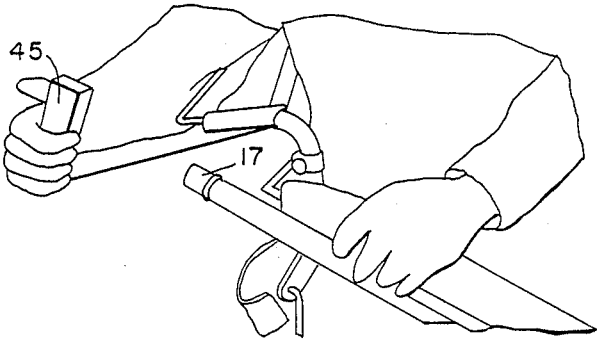
FIG. 11
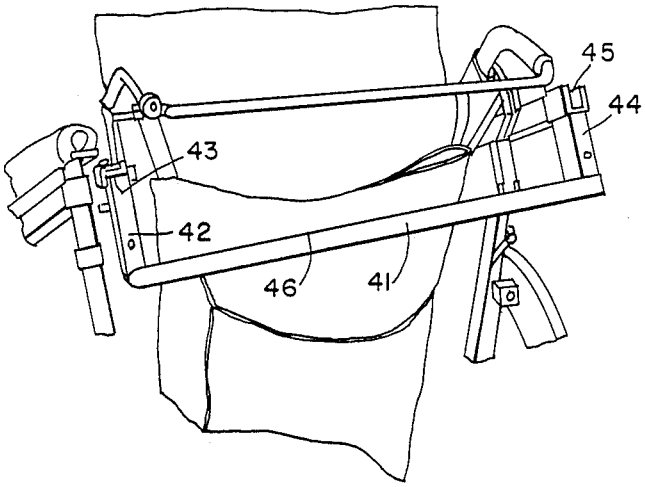
FIG. 12
FIG. 13
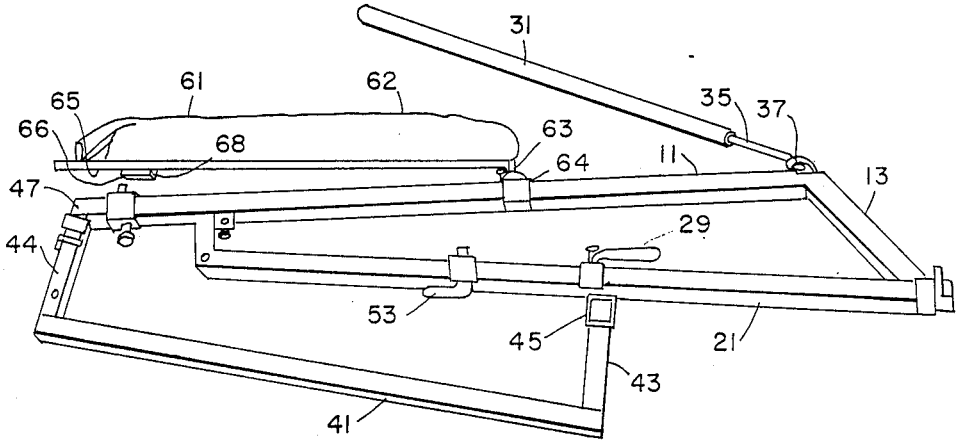

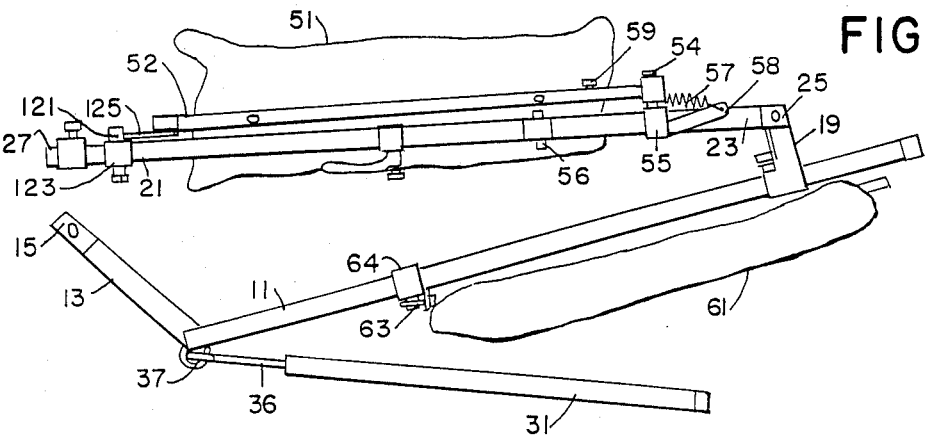
FIG. 14
FIG. 15
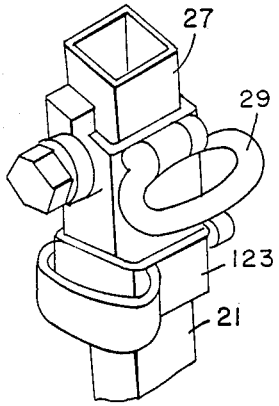
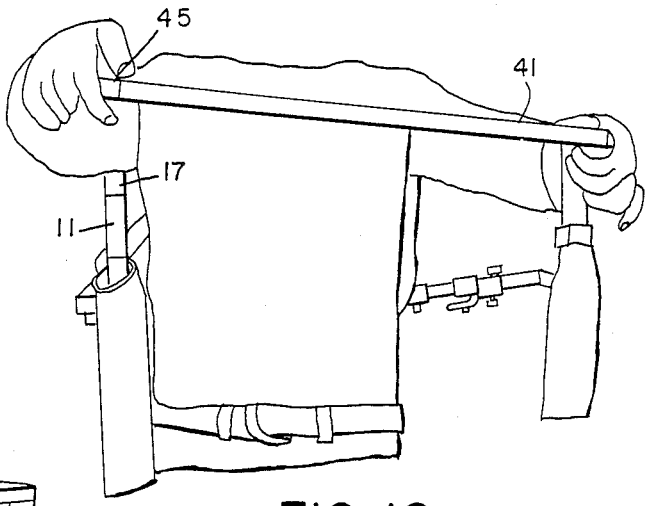
FIG. 16
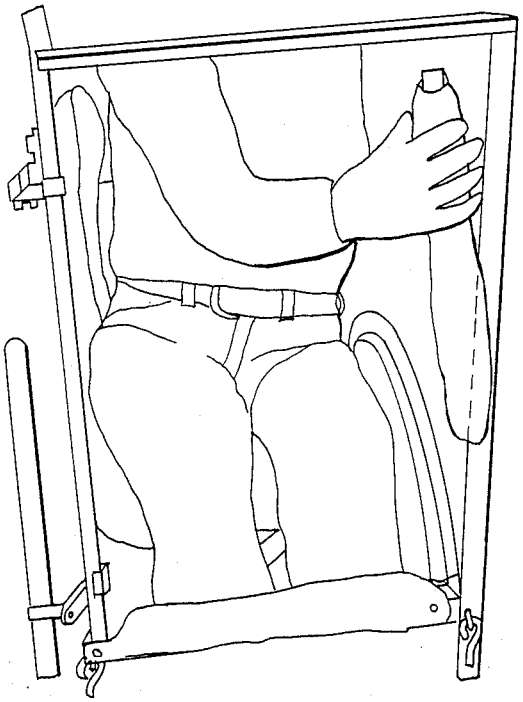
FIG. 17

PORTABLE STANDING ATTACHMENT FOR WHEELCHAIRS

BACKGROUND OF THE INVENTION

Persons having little or no muscular control of the legs usually have to work and operate from a seated position.

Standing up and working while standing up greatly increases mobility of a person and produces physiological benefits, relieves pain, boosts morale and makes a person more independent.

The benefits of standing are best realized when a person can quickly convert a highly mobile wheelchair to a standing aid.

It is highly desirable to construct a standing aid so that it does not reduce the mobility of the wheelchair.

Stability is an absolute requirement of a standing aid. It is highly desirable to have as broad a base as possible and to have as low a center of gravity as possible, both when the device is used as a standing aid and when the device is in its stored position.

In the use of wheelchairs, it is important to reduce weight of the chair to minimize energy required for operating the chair. Effort required for chair operation is directly related to the weight of the chair. Starting, accelerating, slowing, turning, stopping and backing all require effort which is directly related to the weight of the chair. It is highly desirable to make any attachment as lightweight as possible.

It is extremely important that a standing attachment be quickly movable into a standing position and into a stored position with as little effort as possible. It is highly desirable that the device be capable of being assembled and stored with minimal movements of the user.

Wheelchairs are designed with elements of high functionality. One example is the footrest on wheelchairs. To operate wheelchairs in confined spaces and small turning areas it is important that footrests be movable and removable, for example. It is highly desirable that an attachment for wheelchairs be made so that it does not reduce or make more difficult the functioning of existing chair elements.

For those who live and work in wheelchairs, there are some overriding considerations for any assistance device which is to be attached to the wheelchairs. They are weight, bulk, convenience and safety.

Each additional pound added to a wheelchair increases the workload of propelling it. That it is especially significant to the user who is active and uses a wheelchair to travel considerable distances. It is important to use the minimum amount of material and weight in the assistance attachment which is necessary to accomplish the desired function.

A standing attachment must stand rigidly by itself and withstand horizontal forces exerted by the user while pulling into the standing position and while standing and working.

It is highly desirable in any attachment device that the attachment pieces be limited and that, where possible, the pieces be multifunctional, that is, functioning in the stored position as well as in the standing position. That is important for two reasons, the reduction of weight and the convenience of using the device and moving the device between standing and seated positions and disassembling the device. It is important that the elements of the device be firmly locked in place without danger of failure.

If wheelchair attachments extend in any direction past the normal dimensions of wheelchairs when in the stored or seated positions, additional problems are created for users of the wheelchairs. Active wheelchair users must be able to maneuver in small spaces such as those found in the workplace or while travelling, especially in motel or hotel bathrooms. Any increase in the functional dimensions of a wheelchair is undesirable since it decreases maneuverability in confined spaces. In addition, any extension to a rear of a wheelchair can increase difficulty of an assistant who may push a wheelchair.

It is extremely important that all parts of a device not encumber the travel of the wheelchair. If any part of a device in a stored position would hang near a floor, for example, that could cause problems when traversing on even terrain or moving over curbs or pulling a folded chair into a car, for example, because a hanging member could hit a protruding surface and damage the device or stop the progress of a wheelchair.

Low center of gravity is important, and it is extremely important that both the user as well as the wheelchair have low centers of gravity. It is important when using a standing device that the user be in the lowest possible position, with feet resting on the ground. It is also important that the ground contacting outline of the device be well outside of the user's position. When standing in a device where a user's center of gravity is very close to alignment with a point of contact on the floor, an even slight forward lean could create a distinct possibility of toppling forward, for example. That is especially true for tall or heavy individuals, since the only thing to prevent tipping would be the weight of a wheelchair, which is intentionally constructed as lightweight as possible.

One of the most significant advances in wheelchair technology was the development of footrests which unlock and swing out to a lateral position from which they can be dismounted from the wheelchair easily. It is important not to interfere with that function, since it is often necessary to temporarily remove footrests to approach closer to various objects to more safely transfer to things such as, for example, bathtubs and seats in automobiles. It is often necessary to remove footrests or swing them out laterally because a wheelchair user's feet may extend too far forward to fit under some desks or tables, or because there is insufficient room to maneuver in small rooms such as restrooms, which are not wheelchair accessible, but must be used nevertheless.

Wheelchair brakes work well when a user is seated in a wheelchair. Although provisions have been made to securely lock wheels of a wheelchair, when the user is standing there is little weight on the wheelchair wheels, and their ability to prevent movement is limited. It is important that a standing device provide means to prevent movement during use.

Many persons with paralyzed legs have a lack of lateral stability in knee and ankle joints. That can result in the outward bowing of legs while standing. It is extremely important to provide a solution to that problem.

Most wheelchair manufacturers will not honor warranties for frame breakage or malfunction if a frame of a wheelchair has been altered, and especially if anything has been welded to it. It is important that any device attached to a wheelchair not alter the manufacturer's frame and not weld materials to the manufacturer's frame. Besides voiding warranties, altered frames and welded attachments increase the complexity of installation and prevent disassembly of a chair and its attachment for travelling.

When travelling, it is extremely important to be able to pack and ship attachments. Attachments which are large or which are permanently attached to chair frame members are difficult to ship or require special containers or considerations.

Many problems remain in the attachment of devices to wheelchairs to facilitate increased and varied use of the wheelchair. The problems are especially notable when providing standing attachments for wheelchairs.

SUMMARY OF THE INVENTION

The present invention is a portable standing attachment for wheelchairs. The attachment is fully portable and lightweight. It is made to attach to a conventional wheelchair using four clamped-on parts on each side. The portable standing attachment of the present invention does not interfere in any way with the rolling motion or folding capabilities of the wheelchair. The present invention is made of small, lightweight parts which are connected in two assemblies which are easily attached to the wheelchair. When the device is stored on the wheelchair while the wheelchair is used in a seated position, the standing attachment does not increase any dimension of the wheelchair and does not interfere with use of the wheelchair. The standing device is readily positioned as a rigid, braced standing attachment, with minimal movement and little time required by the wheelchair occupant. After using the standing attachment, the device is readily returned to its stored position, with minimal time and movements by the user. When the device is attached to a chair it takes less than 60 seconds to reposition the attachment for standing. When changing the device from the standing to the seated position, it takes less than 60 seconds to return the device to the seated position. Made of steel, the device weighs about 12 lbs. Lightweight alloys reduce the weight of the device to about 7 lbs.

The present invention has few parts. It is built to withstand the stress of standing with lightweight material.

When in the standing position, generally horizontal bars lock onto uprights of a wheelchair backrest, forming a square framework. That allows much of the force exerted against the standing attachment to be dissipated through the frame of the wheelchair. Having horizontal side bars which span the whole distance from the standing attachment to the wheelchair backrest has safety advantages. The user is surrounded at all times by the framework of the attachment while moving into the standing position and when sitting down. Sometimes wheelchair users feel faint when standing. The present invention protects against falling over sideways should such faintness occur during transitions between standing and sitting positions.

The present invention allows direct conversion of pads used as armrests when the attachment is in the retracted position to knee pads which lock solidly when in the standing position. The present invention uses two rigidly backed pads which are locked into grooves in opposing upright members, which makes failure of knee pads virtually impossible. That feature provides safe, firm knee support and greatly enhances the ease of using the standard attachment. No extra parts are carried on wheelchairs to use when the attachment is in the retracted position. By having the armrests/knee pads form double duty, there is less material used, resulting in a reduction of overall bulkiness and weight of the device. The side bars of the present invention articulate on the forward upright members and fold tightly against the back of the wheelchair when the attachment is in the retracted position. That feature permits minimizing the size of the attachment when not in use, and makes transporting the device much easier when it is not attached to the wheelchair.

The rear support of the present invention is mounted on a sleeve which allows it to slide upward when a side member is in the retracted position. The lower end of the rear support locks into a special small sleeve to keep it up and away from the floor.

Retractable stabilizers automatically extend and touch the floor when the standing frame is raised, and automatically retract out of the way when the attachment is not in the standing position. The stabilizers extend well past the vertical axis of the user's center of gravity and substantially eliminate possibilities of toppling forward. The stabilizers rotate laterally with the swing-away footrest and allow unhindered removal and reinstallation of the footrests. When the footrests are removed, the stabilizers are rotated parallel to the vertical axis of the wheelchair to come to rest beside the armrest. That feature allows the stabilizers to be positioned out of the way when the footrests are removed from the chair.

The present invention allows the user's feet to be placed directly and firmly on floor surface. A belt mounted on the bottom frame of the wheelchair prevents backward movement of a person's feet, and the knee pads prevents forward movement. For the whole device to make a transverse movement, a standing individual's feet would have to slide across the floor, which is an unlikely event. Standing directly on the floor also ensures that the height of a user is at a minimum, increasing stability.

An inner lateral pad mounted on each forward frame of the wheelchair prevents lateral knee and ankle joint bowing and prevents possible resultant injury.

In the present invention, no welding is required on the wheelchair, nor is there any alteration of the wheelchair's frame elements which would jeopardize a manufacturer's warranty or which would require persons with special skills, such as welders or mechanics, to install the device on a wheelchair. The present device is easily installed on a wheelchair, is easily removed from the wheelchair, and is readily transported in a conventional suitcase. The present invention has members attached to each other with articulating joints. The members fold upon themselves and fit into a large suitcase. That allows the standing attachment of the present invention to be easily transported by a wheelchair user, even when he does not wish to have the device attached to the wheelchair. The small size, relative simplicity and increased mobility of the present invention make the standing attachment for wheelchairs easily portable. The compact nature of the attachments and their preattachments into two assemblies make the transition from a sitting position to a standing position easily attainable with only a few individual operations.

Installing the device on a wheelchair requires the attachment of four connectors on each side. Each is connected by a clamp which surrounds the wheelchair frame, or a bolt which extends through a preexisting hole.

The first connector is a laterally extending pin, which is clamped to a front side frame member just above a vertical bearing of a caster wheel assembly. A second connector is a locking ring clamped to a backrest frame member near a handle. A third connector is a stabilizer guide connected laterally to a footrest support at its forward lower extremity. A fourth connector is a short vertical tube clamped to a bottom of a wheelchair frame behind a main wheel axle.

Each side mounted assembly has three basic elements. A first front member has a long part, which becomes substantially vertical in the forward position, and a relatively short piece with a pin-receiving bore at its lower end, which extends forward and upward from the pin when in the standing position. A ring is welded outward at the inner section of the two pieces. A stabilizer is pivoted on that ring. The stabilizer passes freely through the stabilizer guide on the footrest support. The third element of the side assembly is the side bar, which has an upper end hinged near an upper end of the front member. A lower rearward end of the side bar has a ring which connects to the locking ring connector. A downward opening hook connected to the side bar slightly below a middle portion fits within the short vertical tube clamped behind the main axle to hold the device in the seated position.

Each side assembly has an armrest. A clamp slides along the front member and has a pivotal connection to a lower end of an armrest support. An upper end of an armrest support has a hook which fits into a loop secured across the side member. Sliding the lower clamp moves the armrest support along the side member to detach the hook from the loop. The clamp is slid downward on the front member to the stabilizer attaching ring. The armrest is rotated 90° across the front of the chair. The armrest is turned 180° on the pivot so that the cushion faces the knee of a user, and the free end of the cushion support is locked in a receiver on the opposite front member. The operation is repeated for the opposite armrest/knee support.

Two additional members complete the standing assembly. The first is a top bar and the second is a rear support.

The top bar is a U-shaped element with two short connecting ends. One end is permanently connected to swing on an upper end of a vertical member. The other end is connectable to the upper end of the other vertical member by a telescoping clamp. In the stored position, the cross bar is connected to both upper ends below the wheelchair guide handles.

The rear support is permanently connected to one side member by a slide which slides betweens the top of the side member and a stop connected to the slide member. The rear support comprises a rear support bar and a cushion which engages the buttocks of a user. A tension spring extending between a forward extended arm on the slide and a position on the rear support arm spaced from the pivot tends to pull the rear support toward the buttocks of a user when the far end of the rear support is released from a keeper loop near the lower end of the side arm. In the stored position, the weight of the rear support holds an extension on the rear support bar in the keeper loop. When the standing assembly is raised for use, sliding the rear support forward releases the extension from the keeper loop, and the spring pulls the rear support forward around the pivot. The extension is then engaged in a hook in the opposite side member, pressing the cushion against the user's buttocks.

The preferred portable standing attachment for wheelchairs has parallel front members having lower ends connected to bolts extending outward from front wheelchair frame members. Side members have rear connections for connecting to upper portions of a rear frame of a wheelchair. The front and side members are hinged together at upper and forward ends thereof respectively. An upper cross member has opposite ends connected to upper ends of the front members. Lower knee support cross members have first ends connected to a front member and second ends connected to an opposite front member. A rear support has first and second ends connected to the first and second side members.

In the preferred portable standing apparatus, hook members are connected to the side members for connecting to lower rear receivers on the wheelchair when the rear ends of the side members are disconnected from the rear upper wheelchair frame.

Preferably second connectors on the front members connect second ends of the lower cross bars to the same front members to which the first end is connected, changing the lower cross members to armrests.

Preferably first and second stabilizers have upper ends pivotally connected to the front members and having medial portions slidable through guides in wheelchair footrest supports.

Preferably a first end of the upper cross member is pivotally connected to the upper end of a first front member, and a second end of the upper cross member is connectable to the upper end of the other front member. The second end of the upper cross member is disconnected before the front members are pivoted rearwardly on the bolts and is reconnected in back of the wheelchair when the front members are placed in the seated position.

Preferably a first end of the rear support member is hinged to a side member, and a second end of the rear support member is connectable to the other side member. The rear support member is movable to a stored position along the first side member when the standing attachment is placed in the seated position.

In the preferred embodiment, each of the members is generally linear and is linearly alignable with each other member when removed from a wheelchair for aligning the members in a small compact package.

In the preferred embodiment, the portable standing attachment for wheelchairs has first and second substantially similar assemblies each having a front member having a transverse hole through a lower end for mounting on a laterally extending bolt on a front lower portion of a frame of a wheelchair. The front member has a relatively short lower portion and a relatively long upper portion angularly interconnected. A stabilizer is pivotally connected to the front member at the joint of the upper and lower portions. A cushioned arm/knee support member has a first end pivotally connected to a slide on the upper portion of the front member at a position near the joint and has a second end connectable to the front member near an upper end thereof in an arm support position and connectable to an opposite front member at a position near the joint as a knee support. Each assembly has a side member having a first end hinged to the front member near an upper end thereof and having a second end connectable to an upper end of a back frame of a wheelchair. Each side member has a medial connector for connecting to a lower portion of a rear of the wheelchair frame in a stored position. An upper cross bar has first and second ends for connecting to upper ends of the front members. A rear support member has first and second ends for connecting to the side members at positions spaced slightly from the first ends of the side members.

A preferred portable standing attachment for wheelchairs has first and second attachment assemblies for mounting on opposite sides of a wheelchair. Each of the first and second assemblies has a front arm with a lower end configured for attachment to a front frame of a wheelchair above a front caster wheel. An upper end of each front arm has a hinge. Each assembly has a side arm. An upper end of the side arm is connected to the hinge. A lower end of the side arm has an attachment for connecting to a backrest frame member of a wheelchair. Each of the assemblies has a stabilizer, with an upper end pivotally connected to the front arm. The stabilizer passes through a guide connected to a footrest support. Each assembly has a pad support pivotally connected at a lower end to the front arm near the stabilizer. The pad support has at its second end a connector which selectively connects to the same front arm in an arm-supporting condition, and to the opposite front arm in a knee-supporting condition. A hand bar has a first end hinged to an upper end of one of the front arms. The hand bar has a second end connectable to an upper end of the other front arm. A rear support bar has a first end hinged to a side arm at a position spaced from the upper end of the side arm. A second end of the rear support bar has a connection for connecting to the side arm in the other assembly at a position spaced from the upper end thereof.

In the preferred portable standing attachment, each assembly has a hook member connected to a medial portion of the side arm for engaging a support tube fixed to a rear lower portion of the wheelchair for holding the side arms when the assemblies are placed in a sitting position.

Preferably a leg belt is connected to front frame members of a wheelchair above caster wheels thereof for preventing rearward movement of a user's feet when standing.

In a preferred embodiment, lateral pads are attached to frontal members of the frame above caster wheels for preventing injury to legs of a user.

The preferred hand bar has a first medial portion which extends across the wheelchair and has end portions angularly connected to the medial portion for spacing the medial portion of the hand bar away from a wheelchair.

In a preferred portable standing attachment, the pivotal connection of the hand bar to an upper end of a front arm permits reversing of the hand bar on the pivot whereby the hand bar may be extended forward from the arms in a standing position and rearward from the arms in a rearward position. Preferably the means for connecting the hand bar to the other front arm comprises a double open-ended telescoping connector for sliding the second end of the hand bar over a second end of the front arm.

Preferably each stabilizer is adjustable in length.

In a preferred embodiment, the portable standing attachment is connected to a wheelchair at lower ends of the front arms, at lower ends of the side arms, and along the stabilizers.

Preferably the stabilizers extend forward from the first arms and contact the ground in a forward position, whereby forward pressure may be placed on the hand bar.

In the preferred portable standing attachment, lower extremities of an occupant are held in the standing attachment by a leg strap extending across a lower frame of the wheelchair, knee pad supports extending between opposite front arms, and a padded rear support extending between opposite side arms.

Preferably the front arms are bent adjacent the stabilizer attachments. Lower portions of the front arms extend generally upward from the bolts when the attachment is in a seated position, and the lower portions of the arms slope forward and upward when the attachment is in the standing position.

These and other and further objects and features of the invention are apparent in the disclosure, which includes the above and ongoing specification, including the claims and the drawings.

BRIEF DESCRIPTION OF THE DRAWINGS

FIG. 5 is a detail of the stabilizer guide.

FIG. 6 shows the short vertical tube connector for holding the assembly in a seated position.

FIG. 7 is a detail of a rear leg-supporting strap and a lateral support cushion.

FIG. 8 is a detail of stabilizers within guides in footrest supports.

FIG. 11 shows the connecting of a cross bar to an end of a front member.

FIG. 12 shows the cross bar connected to upper ends of both front members in the stored position.

FIG. 13 is a detail of one side assembly.

FIG. 14 is a detail of another side assembly.

FIG. 15 is a detail of a mounting ring connected to a lower end of a side member.

FIG. 16 is a detail of connecting a cross bar to an upper end of a front member.

FIG. 17 is a detail of rearranging armrests to create knee supports.

DETAILED DESCRIPTION OF THE DRAWINGS

Figure 1:
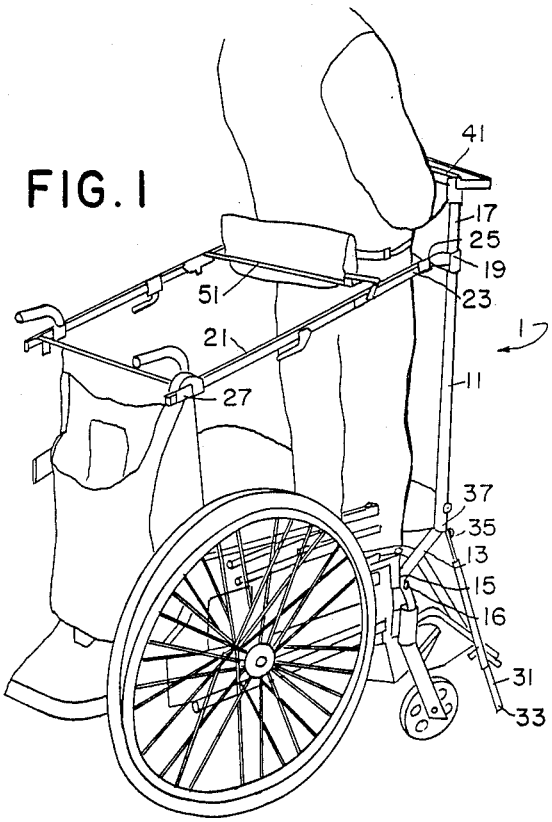
FIG. 1 is a view of the portable standing attachment in use.

Referring to FIG. 1, a portable standing attachment is generally indicated by the numeral 1. The portable standing attachment has a front member 11 with a rigidly attached lower portion 13 having a lower end 15 mounted on a pin 16, which is attached to a wheelchair.

An upper end 17 of the front member 11 supports a small rearward extension 19. A side member 21 has an upper end 23 connected by a hinge pin 25 to extension 19. A lower end 27 of side member 21 is connected to the wheelchair backrest frame. A stabilizer 31 has a lower end 33 which contacts the floor. An upper end 35 of the stabilizer has a ring which is connected to a half-ring 37 welded to front member 11 at the joint of lower portion 13.

The assembly, which consists of front member 11, side member 21 and stabilizer 31, is duplicated on the opposite side of the wheelchair.

An upper cross bar 41 is connected to upper ends 17 of front members 11. A rear support 51 is connected between side members 21.

Figure 2:
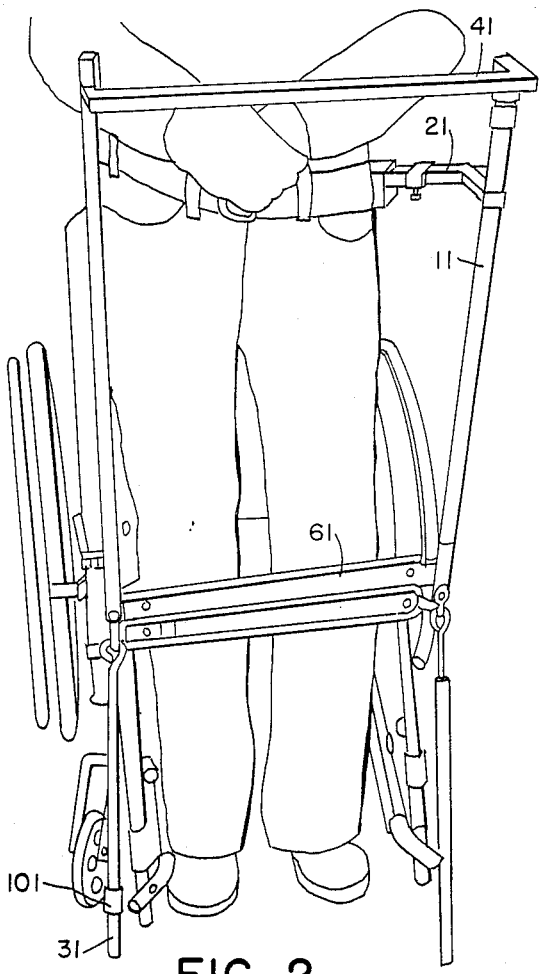
FIG. 2 is a front view of the portable standing attachment shown in FIG. 1.

As shown in FIG. 2, lower knee support cross members 61 are connected between side members 21 to support knees of a user in a standing position.

Cross members 61 as shown in FIG. 7 and lateral pads 71 are connected to front vertical members of the wheelchair to prevent rearward and lateral movement of the legs and feet of a user. Front members 11, side members 21, stabilizers 31, upper cross bar 41 and rear support 51 are removable from the wheelchair in two assemblies. Cross bar 41 is permanently connected to one assembly, and rear support 51 pivots on the other assembly. Cross member 61 and lateral pads 71 remain attached to the wheelchair. Together those elements form the portable standing attachment of the present invention.

Three connectors are mounted on each side of the wheelchair frame and a fourth guide is connected to a footrest support.

Figure 3:
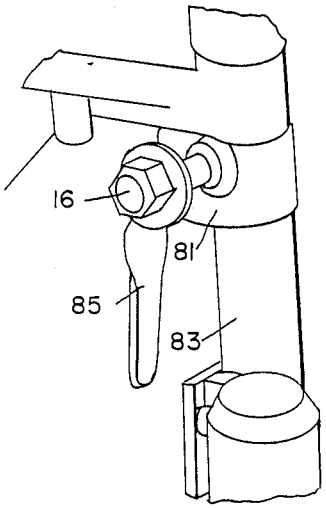
FIG. 3 is a detail of the main mounting pin.

As shown in FIG. 3, a threaded pin 16 is mounted on a bracket 81 which is tightened with a bolt and nut on front frame member 83 of a wheelchair. Wing nut 85 is used to secure the lower end of the front member to the threaded pin 16. The wing nut may be loosened and retightened each time the standing attachment is moved between standing and sitting positions. The long handle on the wing nut 85 ensures ease of operation and retards spinning of a loose nut, which might otherwise result in its detachment from the threaded pin and loss.

Figure 4:
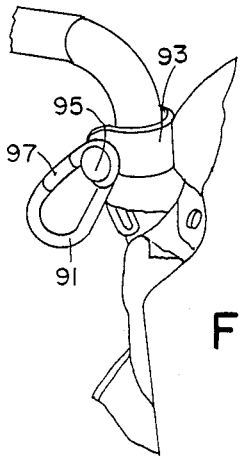
FIG. 4 is a detail of the snap-in safety loop connector.

A shown in FIG. 4, a snap-in safety loop 91 is connected to a top of the wheelchair backrest frame by a bolted bracket 93. Bolt 95 which holds the bracket may be the same bolt which holds the loop 91.

The safety loop may have a slide on its movable portion 97 which prevents unintended movement of the snap-in safety loop 91.

As shown in FIG. 5, stabilizer guide 101 is mounted on a bracket at the lower end of support 103 for footrest 105. The laterally extended guide 101 does not interfere with the upward pivoting of footrest 105 or with pivoting or removing the footrest support.

As shown in FIG. 6, just behind the main axle of the wheelchair, a vertical tube 111 is mounted to receive a hook on the side arm when the attachment is lowered to the sitting position. The four attachments, 81, 91, 101 and 111 shown in FIGS. 3–6, are the only attachments required for the basic wheelchair frame body. An example of a wheelchair to which the attachments may be attached is a Motions Design Quickie II wheelchair.

FIG. 8 shows the stabilizer 31 passing through the guide 101 and contacting the ground when the attachment is in the standing position. The footrest 105 is shown folded upward so that a person may stand on the ground.

As shown in FIG. 8, the upper end 35 of stabilizer 31 is formed as an eye-bolt 36 so that the length of the stabilizer may be adjusted by turning the stabilizer about the eye-bolt.

Figure 9:
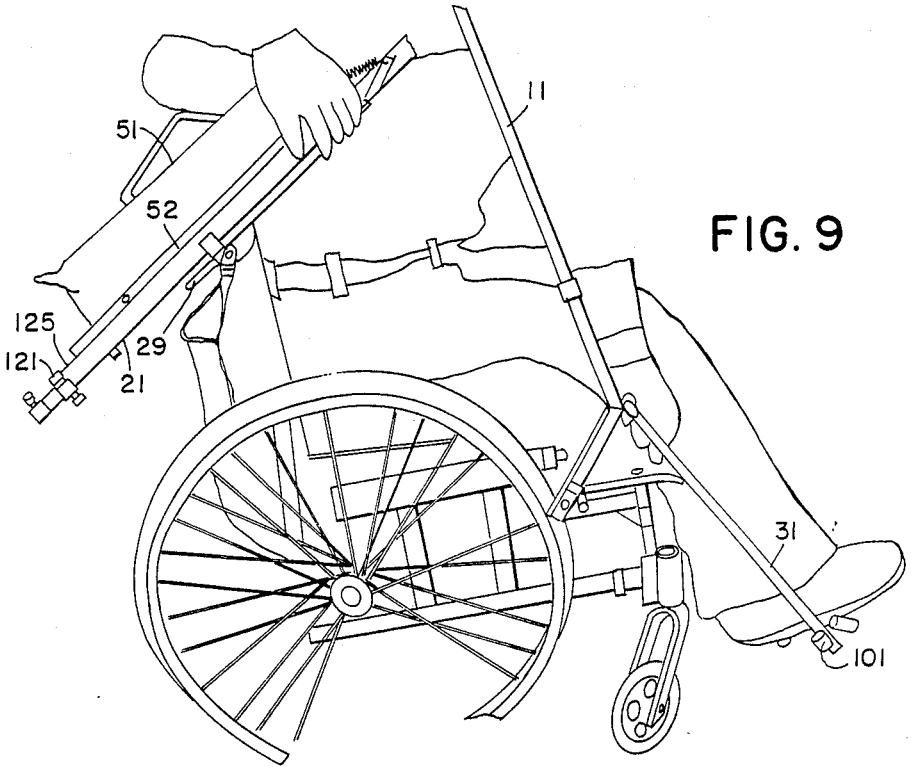
FIG. 9 is a detail showing initial steps of attaching one assembly to a wheelchair.
Figure 10:
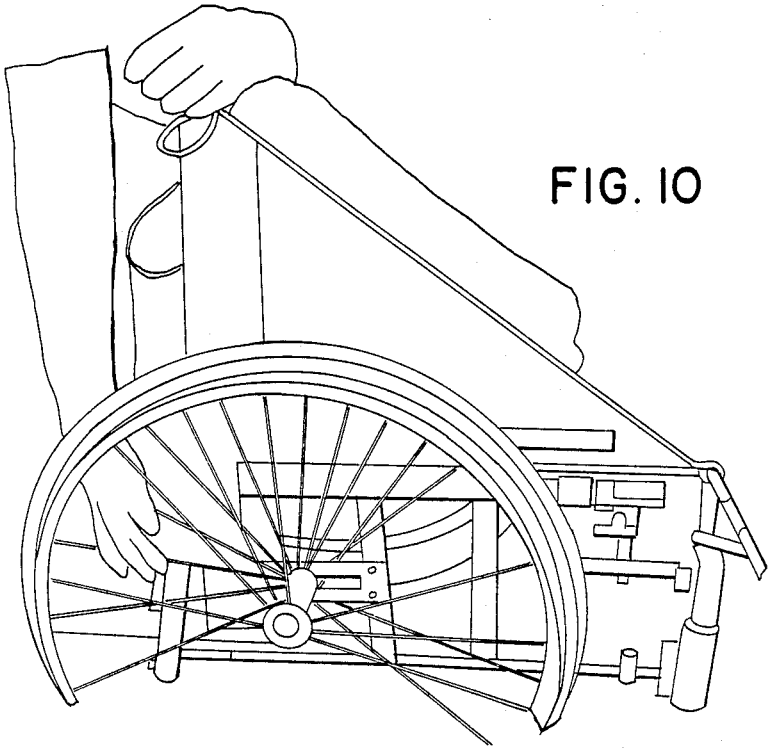
FIG. 10 shows the connecting of a side bar to a holder tube in stored position.
Figure 18:
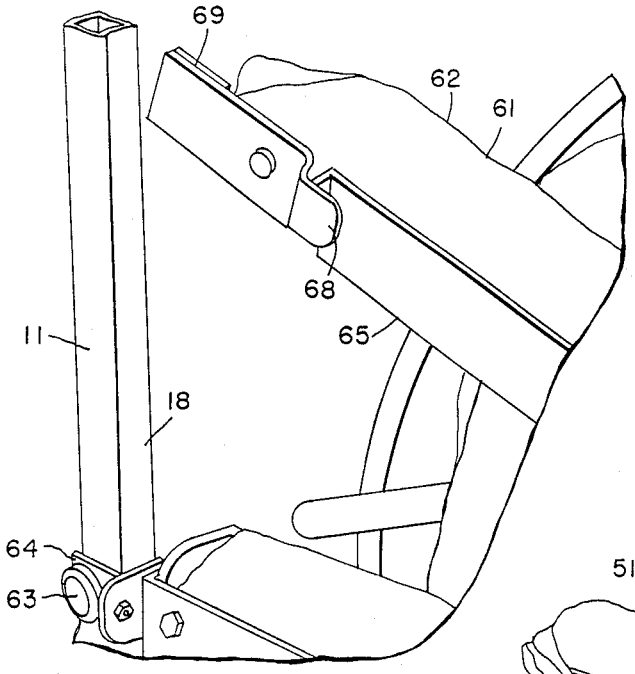
FIG. 18 is a detail of a connection of a knee support.
Figure 19:
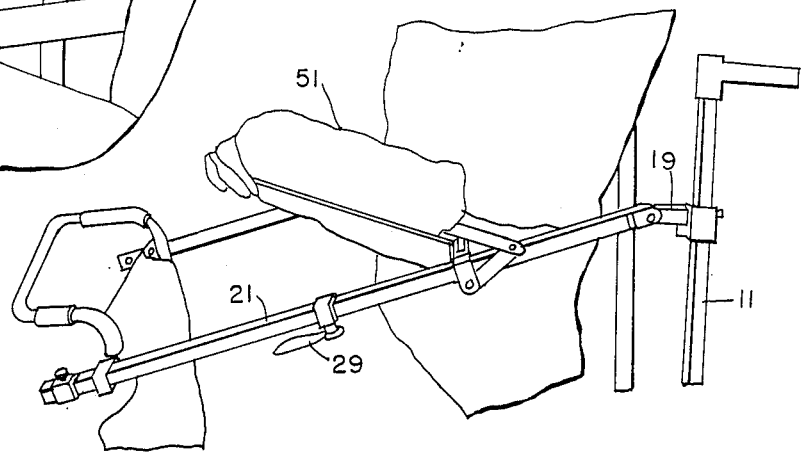
FIG. 19 is a detail of a rear support.
Figure 20:
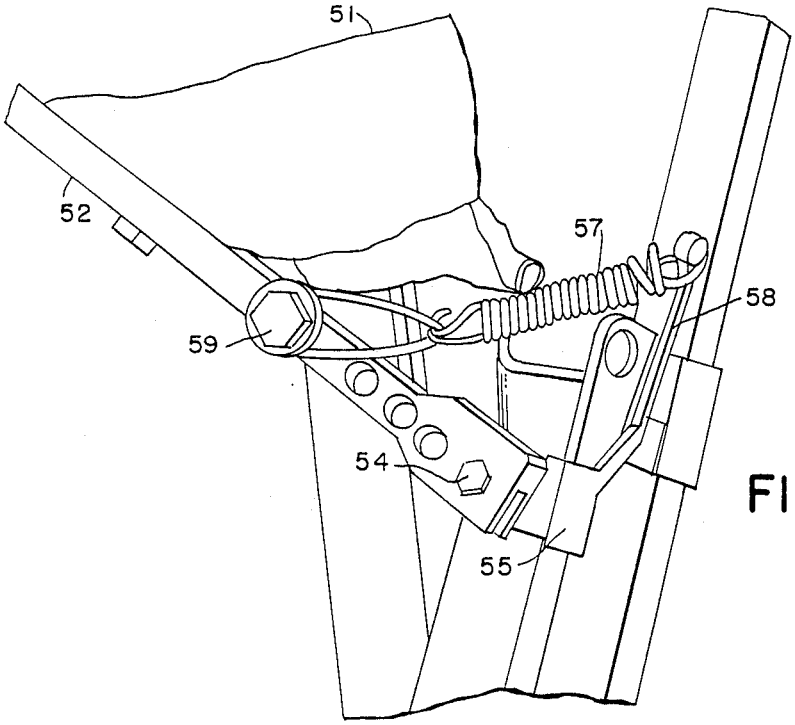
FIG. 20 is a detail of a spring at one end of a rear support.

FIG. 9 shows one of the side assemblies being mounted on the wheelchair by first inserting the stabilizer 31 through the guide 101. Then the opening at the lower end 15 of front member 11 is brought forward and placed on the mounting pin. Thereafter, the assembly is ready to be used, either by rotating it forward to a standing position and tightening the wing nut to hold it in that position while the other assembly is connected to the chair, or by rotating it rearward to the seated position, aligning the hook on the side member with the rear tubular support, as shown in FIG. 10.

The other side assembly is mounted on the wheelchair in the same way. The cross bar 41 is inverted and the end portion 43 of the cross bar 41 is placed on the end 17 of the front member as shown in FIG. 11, so that the cross bar 41 is stored below the wheelchair handle as shown in FIG. 12.

As shown in FIG. 13, the left side assembly has a front member 11 with a lower portion 13. A side member 21 is connected to a rearward extension 19 on the front member. A hook 29 on the side bar fits within the short holder tube mounted on the wheelchair frame behind the main wheel axle to hold the assembly in a sitting position. A similar smaller hook 53 faces in the opposite direction to receive the free end of rear support 51. Cross bar 41 has a medial portion 46 which extends across the wheelchair and two end portions 43 and 44. End portion 43 terminates in a telescoping connector 45 which slides over an upper end of the opposite front member 11. End portion 44 is connected to an upper end of the front member 11 by a universal joint 47, which allows the cross bar to project forward in a standing position and rearward in a seated position. Stabilizer 31 has an eye-bolt 36 which is pivotally connected to a ring 37 welded on front member 11 at the intersection of lower portion 13.

Combined knee/arm cross member 61 has a cushion 62. Universal joint 63 connects one end of a supporting bar 65 to a bracket 64 which slides along the front member 11. A loop 66 on a side of front member 11 opposite extension 16 receives a downward opening hook 68 on the supporting bar 65. Hook 68 engages loop 66 when the supporting bar 65 positions cushion 62 for an armrest. Sliding the armrest upward disengages hook 68 from loop 66 and allows bracket 64 to slide downward toward ring 37 to position the cross member 61 in a knee-supporting position.

As shown in FIG. 14, the right side assembly has a front member 11, a side member 21, and a stabilizer 31, and a cross member 61, which are similar to the similarly numbered elements in the left side assembly shown in FIG. 13. The left side assembly carries the rear support 51, which has a support bar 52 movable on a slide 55.

Rear support bar 52 is mounted on pin 54, which is secured in slide 55. Slide 55 freely moves along side member 21 between stop 56 and the end of the bar which is connected to extension 19 on front member 11. A spring 57 is connected to an arm 58 on the slide 55 and to a bolt 59 on the support bar 52. The spring urges the rear support forward about pin 54 so that the opposite end of the rear support bar 52 may be grasped and inserted in the hook 53 in the opposite side member 21.

A loop 121 fixed on side member 21 by bracket 123 receives an extension 125 on rear support bar 52 to hold the end of the bar when side member 21 is held vertically in the sitting position. Releasing extension 125 from loop 121 simply requires upward sliding of the rear support along the side member 21 until the extension is released from the loop. Then the spring 57 urges the rear support 51 toward the buttocks of a user.

FIG. 15 is a detail of the loop 29 attached to the lower end 27 of side member 21 to hook the lower end of the side member to the snap-in safety loop 91 on the upper side of the wheelchair back frame when the standing attachment is in a standing position.

In operation, to raise the standing attachment one first engages the wheelchair brakes. Then one reaches behind, detaches one end of cross bar 41, and drops the cross bar about its pivot. The wing nut on one mounting bolt 16 is loosened. Reaching behind and gripping one side member 21 in its stored position, the side member is raised, and the loop 29 on the lower end of the side bar is connected to the snap-in safety loop 91 on the seat back frame. The wing nut is tightened. The other wing nut is loosened; the second side member is lifted into position, and the ring 29 is secured to the snap-in safety loop 91 on the other side of the seat back frame. That wing nut is tightened. The cross bar 41 is inverted on its end portion 43, and telescoping connection 45 is slid downward over the upper end 17 of the first front member 11, as shown in FIG. 16.

In the next operation, the right armrest is raised, lifting its hook 68 from loop 66 on the front member, and the bracket 64 is slid downward until it contacts the ring 37. The arm support is reoriented 90° across the front and is turned 180° on its universal joint 63, so that the cushion faces inward toward the knees of the user. An extension 69 is pressed into a tight fitting slot 18 in the front member 11.

The same steps are repeated for the arm cushion on the left front member, which then becomes a knee support cushion. The left arm/knee support cushion is positioned on top of the right knee/arm support cushion when assembled in the standing position. During all of these motions the main wheelchair brakes have been engaged. Checking again to see that the brakes are fully engaged and that the lower legs are against the cross member 61 and the lateral pads 71, one pulls himself from a sitting position to a standing position using the upper cross bar 41. When reaching the standing position, the rear support member 51 is grasped and slid forward along side member 21, releasing extension 125 from loop 121. The pivot bracket slides rearward to the stop 56 as the spring swings the opposite end of rear support 51 forward. With the left hand one reaches the rear support and pulls it up over and into the hook 53 on the left side member 21. The person, in a standing position, is now ready to conduct operations.

When ready to be seated in the wheelchair, with the left hand one releases the rear support 51 from the hook 53. Grasping the upper cross member 41, one lowers to the sitting position, automatically pushing back the rear support. Once in the seated position, one grasps the rear support 51, aligns it with right side member 21, slides it forward and then rearward to engage the extension 125 in the loop 121. Next one lifts the top knee pad, twists it 180°, swings it into alignment with the left front member 11, and raises and lowers it to engage hook 68 with loop 66. The same procedure is followed with the right knee pad/armrest. The right wing nut is loosened and the right snap-in safety loop 91 is opened to release loop 28. The right assembly is lowered rearward, sliding hook 29 into the short vertical tube at the rear of the wheelchair.

The same procedure is repeated for the left side. Reaching behind with the left hand without turning the body, one swings the upper cross bar 41 into a horizontal position immediately in back of the wheelchair. One takes the end portion 44 in the right hand and attaches the telescoping connector 45 to the upper end 17 of the right front member 11.

While the invention has been described with reference to specific embodiment, modifications and variations of the invention may be constructed without departing from the scope of the invention.

I claim:

1. A portable standing attachment for wheelchairs comprising first and second attachment assemblies for mounting on opposite sides of a wheelchair, each of the first and second assemblies having a front member with a first end configured for attachment to a front frame of a wheelchair above a front caster wheel, a second end of each front member having a hinge, and each assembly having a side member with a first end of the side member connected to the hinge, a second end of the side member having attachment means for connecting to a backrest frame of the wheelchair, each of the assemblies having a stabilizer having a first end pivotally connected to the front member at a position along the front member nearer the first end than the second end, the stabilizer passing through a stabilizer slide connected to a footrest support, each of the assemblies having a cross member pivotally connected at one end to the front member at a position thereof spaced from the pivotal connection of the stabilizer, the cross member having at the second end a connector for selectively connecting to the front member in an armrest condition and to an opposite front member in a knee-supporting condition; a cross bar having a first end pivoted to a second end of one of the front members, the cross bar having a second end connectable to a second end of the other front member, a rear support bar having a first end hinged to the side member at a position spaced from the first end of the side member, a second end of the rear support bar having a connection for connecting to the side member in the other assembly at a position spaced from the first end thereof.

2. The portable standing attachment described in claim 1, wherein each side assembly has a hook member connected to a medial portion of the side member for engaging a holder tube fixed to a rear lower portion of the wheelchair for holding the side member and the side assembly when the assemblies are placed in a sitting position.

3. The portable standing attachment of claim 1, wherein the cross member connects to front frame members of the wheelchair above caster wheels for preventing rearward movement of feet when standing.

4. The portable standing attachment of claim 1, further comprising lateral pads attached to the front frame members above caster wheels for preventing injury to lateral portions of legs of a user.

5. The portable standing attachment of claim 1, wherein the cross bar has a medial portion which extends across the wheelchair and has end portions angularly connected to the medial portion for spacing the medial portion of the cross bar away from a wheelchair.

6. The portable standing attachment of claim 1, wherein the pivotal connection of the cross bar to a second end of a front member permits reversing of the cross bar, so that the cross bar is extended forward from the front member in a standing position and rearward from the front members in a sitting position, and wherein the means for connecting the cross bar to the other front member comprises a telescoping connector for sliding the second end of the cross bar over a second end of the other front member.

7. The portable standing attachment of claim 1, wherein each stabilizer is adjustable in length.

8. The portable standing attachment of claim 1, wherein the attachment is connected to a wheelchair at first ends of the front members, at second ends of the second side members, and along the stabilizers.

9. The portable standing attachment of claim 8, wherein the stabilizers extend forward from the front members and contact the ground in a forward position whereby forward pressure may be placed on the cross bar.

10. The portable standing attachment of claim 1, wherein lower extremities of an occupant are held in the standing attachment by a leg strap extending across a lower frame of the wheelchair, cross members extending between opposite front members, and a padded rear support extending between opposite side members, and wherein the cross bar limit forward movement of an upper body of the occupant.

11. The portable standing attachment of claim 1, wherein the front members are bent adjacent the stabilizer attachments whereby lower portions of the front members extend generally upward from the connectors when the attachment is in a sitting position, and wherein the lower portions of the front members slope forward and upward when the attachment is in the standing position.

12. A portable standing attachment for wheelchairs comprising parallel front members having lower ends connected to bolts extending outward from front wheelchair frame members and parallel side members having rear connections for connecting to upper portions of rear frame members of a wheelchair, the front and side frame members being hinged together at upper and forward ends thereof respectively, an upper cross member having opposite ends connected to upper ends of the front members and lower cross members having first ends connected to one front member and having second ends connected to an opposite front member, a rear support having first and second ends connected to the first and second side members.

13. The portable standing apparatus of claim 12, further comprising hook members connected to the side members for connecting to lower rear portions of the wheelchair when the rear ends of the side members are disconnected from the rear upper wheelchair frame.

14. The apparatus of claim 12, further comprising second connectors on the front members for connecting second ends of the lower cross bars to the same front members to which the first ends are connected, changing the lower cross members to arm rests.

15. The apparatus of claim 12, further comprising first and second stabilizers having upper ends pivotally connected to the front members and having medial portions slidable through guides in wheelchair footrest supports.

16. The apparatus of claim 12, wherein the first end of the upper cross member is pivotally connected to the upper end of a first front member and where the second end of the upper cross member is connectable to the upper end of the other front member for disconnecting the second end of the upper cross member before the front members are moved rearwardly around the bolts and for reconnecting the upper cross member in back of the wheelchair when the front members are placed in the sitting position.

17. The apparatus of claim 12, wherein a first end of the rear support member is hinged to a side member and a second end of the rear support member is connectable to the other side member, the rear support member being movable to a stored position along the first side member when the standing attachment is placed in the seated position.

18. The apparatus of claim 12, wherein each of the elements is generally linear and is linearly alignable with each other element when removed from a wheelchair for aligning the elements in a small compact package.

19. A portable standing attachment for wheelchairs comprising first and second substantially similar assemblies each having a front member having a transverse hole through a lower end for mounting on a laterally extending bolt on a front lower portion of a frame of a wheelchair, the front member having a relatively short lower portion and a relatively long upper portion angularly interconnected, a stabilizer pivotally connected to the front member at the joint of the upper and lower portions, a cross member having a first end pivotally connected to the upper portion of the front member at a position near the joint, and having a second end connectable to the front member near an upper end thereof in an arm support position and connectable to an opposite front member at a position near the first connection of the cross member, each assembly having a side member having a first end hinged to the front member near an upper end thereof and having a second end connectable to an upper end of a backrest frame of a wheelchair, each side member having a medial connector for connecting to a lower portion of a rear of the wheelchair frame; an upper cross bar having first and second ends for connecting to upper ends of the front members; and a rear support member having first and second ends for connecting to the side members at positions spaced slightly from the first ends of the side members.

20. The portable standing attachment of claim 19, wherein the cross bar has a first end pivotally connected to an upper end of one front member and has a second end which is connectable to an upper end of a second front member; and wherein the rear support member has a first end pivotally connected to a first side member and has a second end connectable to a second side member.

* * * * *